US005199904A

United States Patent [19]

Wharton

[11] Patent Number: 5,199,904

[45] Date of Patent: Apr. 6, 1993

[54] ELECTRICAL OFFSET ADAPTER PLUG

[75] Inventor: Richard F. Wharton, Glenview, Ill.

[73] Assignee: Safco Corporation, Chicago, Ill.

[21] Appl. No.: 925,188

[22] Filed: Aug. 6, 1992

[51] Int. Cl.[5] ..... H01R 13/00

[52] U.S. Cl. ..... 439/668; 439/675

[58] Field of Search ..... 439/660, 668, 669, 675

[56] References Cited

U.S. PATENT DOCUMENTS

| | | | |
|---|---|---|---|
| 2,238,834 | 4/1941 | Travers | 439/669 |
| 4,267,430 | 5/1981 | Downey | 439/675 |
| 4,861,132 | 8/1989 | Moulin | 439/669 |

*Primary Examiner*—Joseph H. McGlynn
*Attorney, Agent, or Firm*—Augustus G. Douvas

[57] ABSTRACT

An electrical offset adapter plug for accessing an electrically powered receptacle housed within an ash tray compartment having a restricted path by which the adapter plug is inserted into the receptacle. The offset plug comprising a composite structure including a first adapter-plug section having a generally tubular body which is relatively longer than its tubular diameter and which is adapted for insertion into the receptacle, a second enclosure section defining an internal chamber for housing optional electrical components and serving also as a gripping handle for manual insertion of the offset adapter plug into the receptacle, and a third section defining an offset elbow joining the adapter-plug section to the enclosure section with the enclosure section being disposed substantially offset relative to both the length and tubular diameter of the adapter-plug section. The optional electrical components may be an electrical circuit board for power conversion, or alternatively, one or more female auxiliary adapter-plug receptacles.

16 Claims, 4 Drawing Sheets

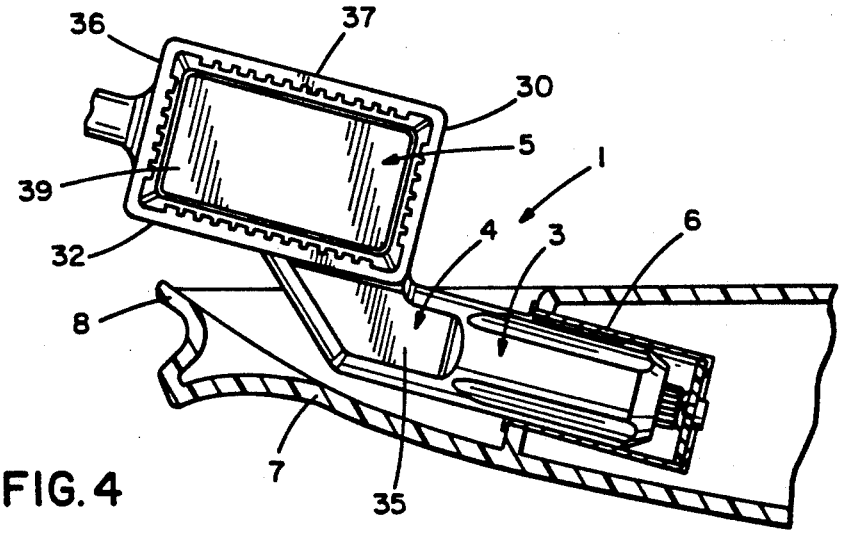
FIG. 4
FIG. 5
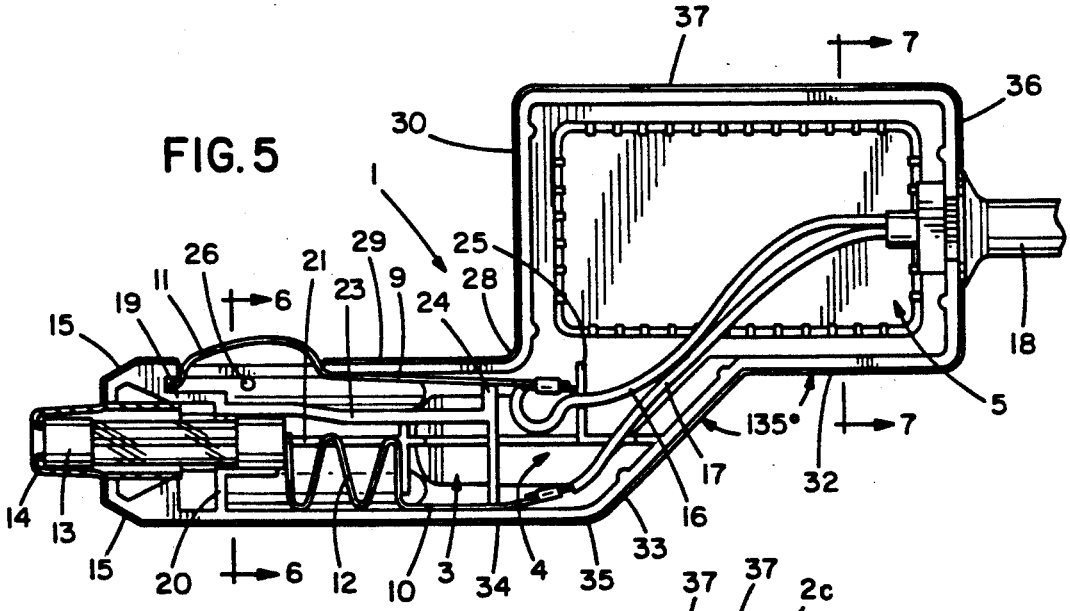
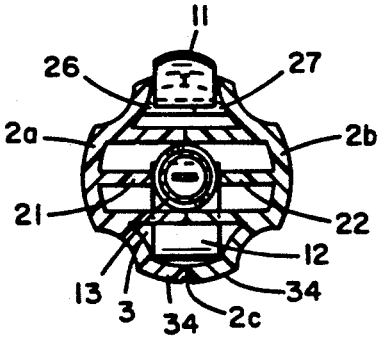
FIG. 6
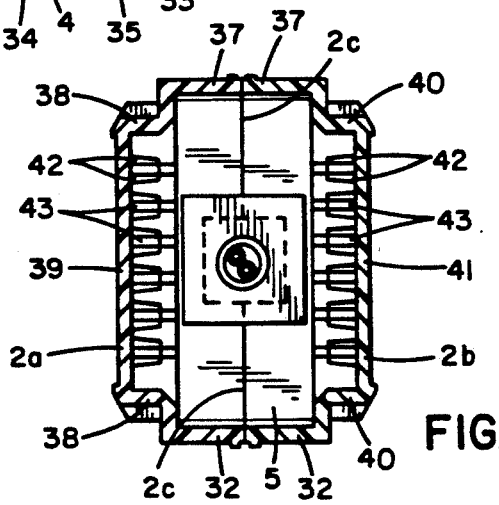
FIG. 7

ELECTRICAL OFFSET ADAPTER PLUG

BACKGROUND OF THE INVENTION

This invention relates to electrical connecting devices, and in particular to an electrical offset adapter plug which may be inserted into the receptacle of an automotive cigarette-lighter assembly so that various low-voltage loads may be operated by the electrical system of the vehicle. An offset adapter-plug design is disclosed which facilitates insertion of an adapter plug into a receptacle having restricted access because the receptacle is housed in an ash tray compartment, for example.

In recent years, a great variety of electrical appliances have become available for operation by the low-voltage, direct-current power of the electrical systems of cars, power boats, and campers. These appliances are generally interconnected to the electrical system of the vehicle by use of an adapter plug or connector which is inserted into the cigarette-lighter socket or receptacle. Electrical appliances and accessories which can be operated from a vehicle electrical system vary widely and include portable television sets, tape recorders, trouble lights, window defrosters, electrical shavers, electric toothbrushes, can openers, food mixers, and the like.

Such prior art devices useful for electrical connection with cigarette-lighter receptacles include Focosi U.S. Pat. No. 2,954,544, Schwartz U.S. Pat. No. 3,099,505, Busch et al U.S. Pat. No. 3,377,610 and Busch U.S. Pat. No. 3,865,463.

In many instances, the variety and complexity of equipments operable from a vehicle electrical system require conversion of the vehicle voltage to a different selectable output value, or alternatively dual power outputs are required to operate plural units.

It is convenient to house the necessary voltage-conversion circuitry or dual-output receptacles inside the adapter-plug housing. But such association of necessity enlarges substantially the adapter-plug housing dimensions both in length and in width.

Vehicle manufacturers have in recent years removed cigarette-lighter receptacles from an exposed access mounting on the vehicle dash and control panels, and have instead concealed these receptacles within ash-tray compartments or in other difficult-to-access areas. As a result, many prior-art adapter plugs are too large or improperly dimensioned for easy insertion into receptacles having a restricted access. This particular situation exists in those instances in which auxiliary electrical components are incorporated into an adapter plug housing.

SUMMARY OF THE INVENTION

Accordingly, a principal object of this invention is to provide an electrical adapter-plug design which may be readily inserted into receptacles that are either concealed within vehicle ash-tray compartments or in other difficult-to-access compartments.

Another object is to provide a simplified and efficient adapter-plug design for integrating into a single housing having both an adapter-plug section, and also an additional section for housing electrical components which provide voltage conversion or plural power outlets.

Another object is to provide a basic offset adapter-plug design that may incorporate optional components for providing an auxiliary electrical function.

In a first preferred embodiment, the offset adapter plug of this invention comprises a composite structure including a first adapter-plug section having a generally tubular body which is relatively longer than its tubular diameter and which is adapted for insertion into a cigarette-lighter receptacle, a second enclosure section defining an internal chamber for housing optional electrical components and serving also as a gripping handle for manual insertion of the offset adapter plug into the receptacle, and a third section defining an offset elbow joining the adapter-plug section to the enclosure section. The enclosure section is disposed substantially offset relative to both the length and tubular diameter of the adapter-plug section. In this embodiment, as with the other embodiments disclosed, the offset elbow section enables the offset adapter plug of this invention to be configured so that it will in most instances access cigarette-lighter receptacles concealed in ash trays or other confined areas.

In the first preferred embodiment, the enclosure section provides an internal chamber or passageway for electrical wire conductors which connect to an output-power cord passing out of the enclosure section. In a second preferred embodiment, an electrical circuit board is housed within the chamber of the enclosure section. This circuit board may contain components for providing a variety of electrical functions; typically, however, the circuit board may contain voltage-conversion circuitry for operating appliances or accessories requiring an operating voltage which differs from the cigarette-lighter voltage.

The same enclosure-section housing design is employed in both the first and second embodiments. In the third preferred embodiment, the enclosure-section housing is modified to incorporate dual, female, auxiliary-output-power receptacles. These receptacles are connected to the adapter-plug section, and thus output the same voltage at dual outlets that is developed at the cigarette-lighter receptacle. One or two secondary adapter plugs may be inserted into the dual auxiliary receptacle to provide power for one or two secondary electrical equipments as is desired.

DESCRIPTION OF THE DRAWINGS

In order that all of the structural features for attaining the objects of this invention may be clearly understandable, reference is made to the accompanying drawings in which:

FIG. 4 is an elevation view related to FIGS. 2 and 3 which shows the adapter plug fully engaging the receptacle;

FIG. 5 is an elevation view of the adapter plug shown in the prior figures with one-half of the adapter-plug housing removed to show the internal construction and wiring;

FIG. 6 is a section view taken along line 6—6 of FIG. 5 which shows the disposition of the adapter-plug fuse;

FIG. 7 is a section view taken along line 7—7 of FIG. 5 which shows details of the handle portion of the adapter-plug housing;

DETAILED DESCRIPTION OF THE PREFERRED EMBODIMENT

Figure 1:
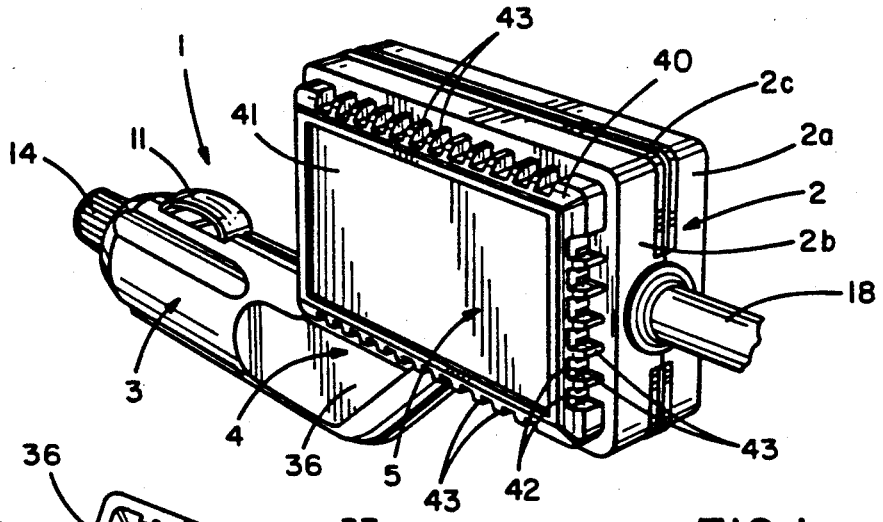
FIG. 1 is a perspective view of a first embodiment of the adapter plug of this invention which has an offset elbow supporting a portion of the adapter-plug housing which serves as a manual grip handle.

A first preferred embodiment of the electrical offset adapter plug 1 of this invention is shown in FIGS. 1 through 7. A principal novel structural feature relates to adapter-plug housing 2, which includes integrally joined male adapter-plug section 3, elbow section 4, and electronics enclosure section 5.

Elbow section 4 provides an offset disposition for enclosure section 5 relative to adapter-plug section 3. With this arrangement, substantially all of enclosure section 5 is positioned above (as shown in FIGS. 1 through 5) any imaginary longitudinal-extension lines projected from the peripheral profile of an adapter-plug section 3. This offset design enables adapter plug 1 to be inserted into a cigarette lighter receptacle 6 housed within and supported by vehicular ash tray 7 (FIGS. 2, 3, and 4) whose shape and dimensions will not permit a prior-art elongated adapter plug supporting an electronics enclosure to access adequately the ash tray.

With the specific ash tray 7 shown in the drawings, the upwardly projecting profile of ash-tray lip 8 (FIG. 2) will engage and obstruct a prior-art adapter plug having an electronic enclosure supported in a non-offset disposition relative the adapter-plug body. This obstructive engagement will prevent operable mating of the plug with a powered receptacle.

Figure 2:
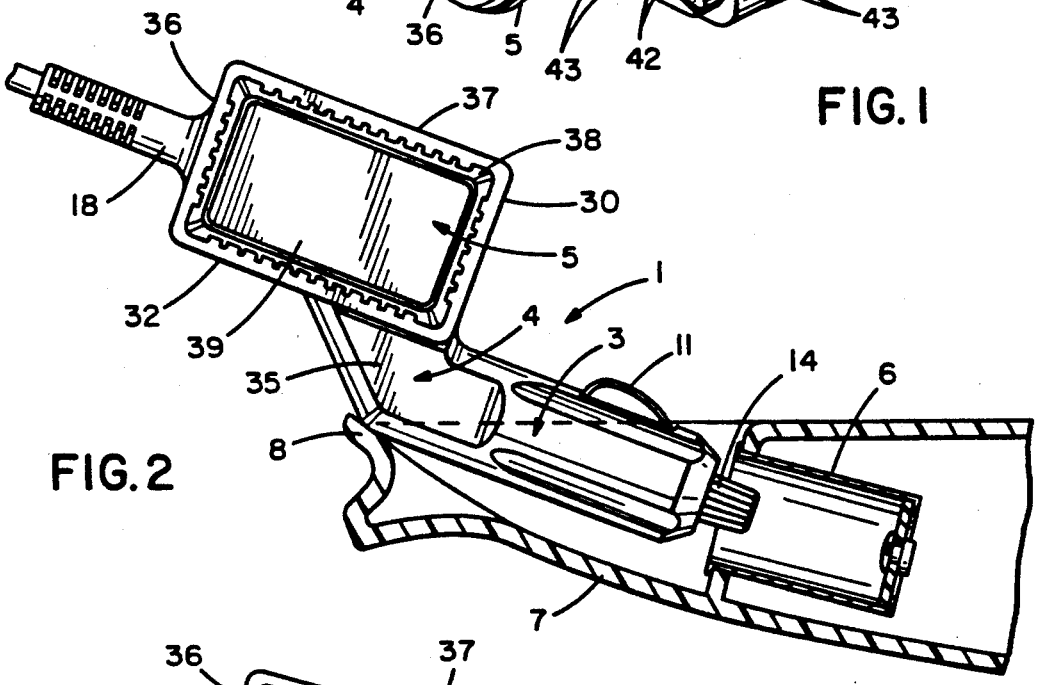
FIG. 2 is a side elevation view of the adapter plug of FIG. 1 being applied to a cigarette-lighter receptacle housed within a vehicle ash tray.
Figure 3:
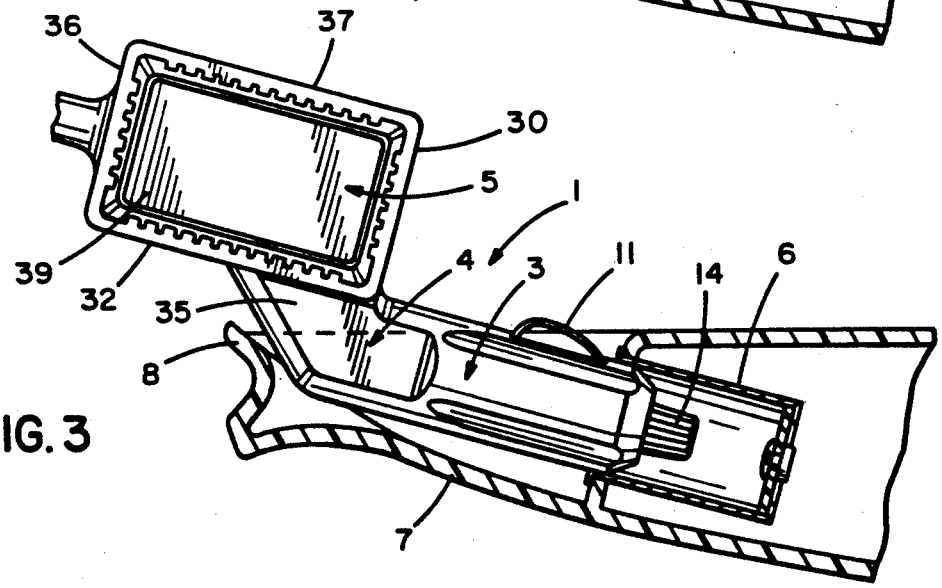
FIG. 3 is an elevation view related sequentially to FIG. 2 which shows the adapter plug initially engaging the receptacle.

As is shown in the sequence of FIGS. 2 through 4, elbow section 4 of offset adapter plug 1 slips by ash-tray lip 8 (FIG. 2) to establish aligned entry into receptacle 6 (FIG. 3) to engage fully receptacle 6 (FIG. 4).

Adapter-plug housing 2 is assembled by press-fitting two housing halves 2*a* and 2*b* together and gluing these halves at junction line 2*c* (FIGS. 1, 6 and 7). Housing 2 is preferably fabricated from an opaque plastic, such as black polypropylene.

The internal cavity of adapter-plug section 3 houses two electrical conductor plates 9 and 10 preferably fabricated of nickel-plated spring steel (FIG. 5). Conductor plate 9 is arched at one end to project beyond housing 2 to form a negative spring contact 11. Conductor plate is formed into a pleated section 12 which serves as a resilient spring to drive fuse 13 and in turn positive contact tip 14 beyond nose section 15 of housing 2.

Output-cord leads 16 and 17 are connected to conductor plates 9 and respectively. Accordingly, when offset adapter plug 1 is inserted into receptacle 6, electrical current applied to contacts 11 and 14 is conducted to output line cord 18 connected to leads 16 and 17.

In the particular offset adapter-plug embodiment shown in FIGS. 1 through 7, electronics enclosure section 5 does not contain an electrical circuit board or other components to perform an auxiliary function upon the receptacle 6 voltage, such as, voltage conversion. Accordingly, the internal cavity of enclosure section 5 merely serves as a passageway for output cord leads 16 and 17. In this embodiment, the principal function of enclosure section 5 is to serve as a manual gripping handle for insertion and removal of offset adapter plug 1 relative to receptacle 6.

Adapter-plug section 3 is formed with a plurality of internally housed plastic ribs and guide pins which serve to locate and hold in place conductor plates 9 and 10, fuse 13, and positive contact tip 14 is carried on fuse 13. Ribs 19, 20 and 21 integrally molded to housing section 2*a* (FIG. 5) and rib 22 integrally molded to housing section 2*b* (FIG. 6) locate and hold fuse 13. Ribs 19, 23, 24 and 25 (FIG. 5) retain conductor plate 9, and pins 26 and 27 (FIGS. 5 and 6) prevent excessive deformation of spring contact 11.

Elbow section 4 is defined in part by a right-angle junction 28 (FIG. 5) which joins the upper wall 29 of adapter-plug section 3 to wall 30 of electronics enclosure 5. The upper edge of wall 29 is essentially in axial alignment with bottom wall 32 of enclosure 5. Elbow section 4 is further defined by inclined wall 33, which is disposed at an angle of approximately 135° relative to wall 32 (FIG. 5). The lower wall 34 of adapter-plug section 3 joins included wall 33 at junction 35.

Lower adapter wall 34 preferably extends beyond upper adapter wall 29 so that junction 35 is offset laterally from junction 28 to provide added strength to elbow section 4. Elbow section 4 is formed with a set of flat sidewall 35 and 36 (FIGS. 1 through 4) which merge into bottom wall 32 of enclosure 5. Peripheral enclosure walls 30, 32, 36 and 37 generally define a rectangular configuration for enclosure 5. Rectangular offset shoulder 38 joins enclosure sidewall 39 (FIG. 7) to peripheral walls 30, 32, 36 and 37, and rectangular offset shoulder 40 (FIG. 7) joins enclosure sidewall 41 to peripheral walls 30, 32, 36 and 37. A rectangular series of vent holes 42 separated by a similar series of projecting baffles 43 (FIGS. 1 and 7) are formed along the periphery of each shoulder 38 and 40 to provide ventilation for any electrical components (not shown) located within enclosure 5 and generating heat.

Figure 8:
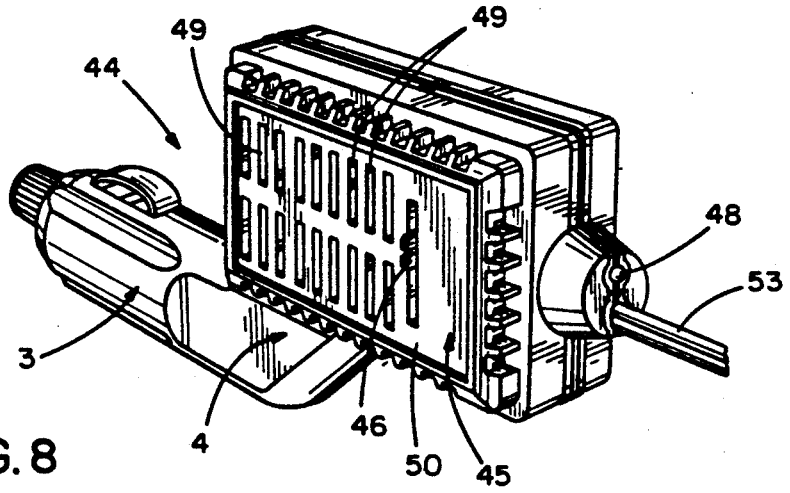
FIG. 8 is a perspective view of a second embodiment of the adapter plug of this invention in which the handle portion of the adapter-plug housing contains circuitry for performing an auxiliary function, such as, voltage conversion.
Figure 9:
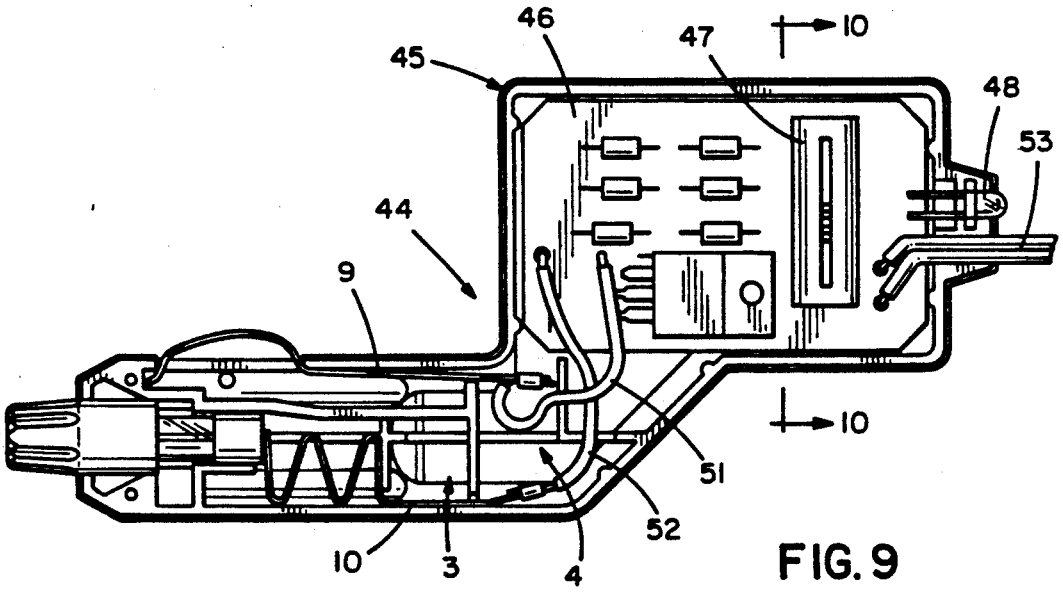
FIG. 9 is a elevation view of the adapter plug shown in FIG. 8 with one-half of the adapter-plug housing removed to show a circuit board contained within the handle-portion of the housing.
Figure 10:
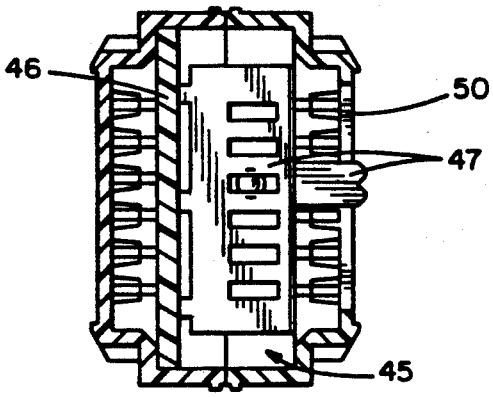
FIG. 10 is a section view taken along line 10—10 of FIG. 9 modified, however, to show the entire housing in section.
Figure 11:
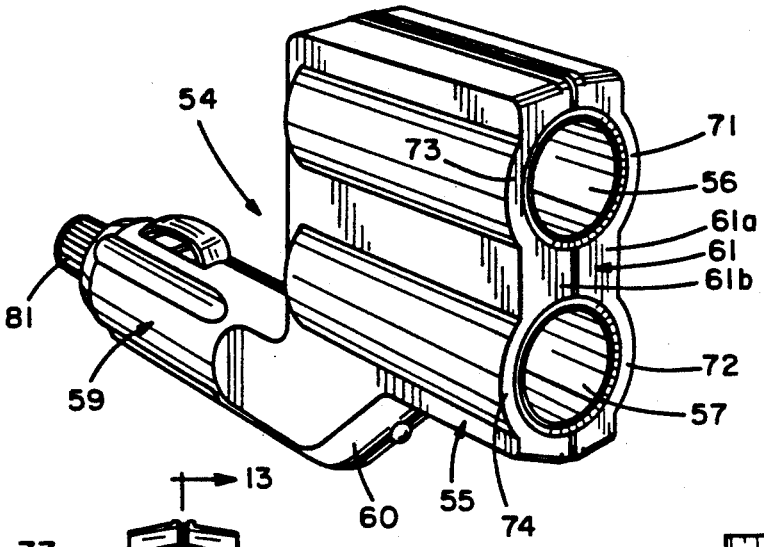
FIG. 11 is a perspective view of a third embodiment of the adapter plug of this invention in which the handle portion of the housing contains two identical auxiliary receptacles for receiving a set of secondary adapter plugs.
Figure 12:
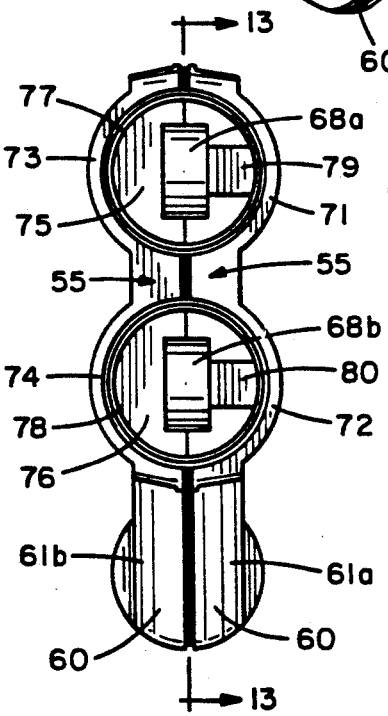
FIG. 12 is an end view of the adapter plug of FIG. 11.
Figure 14:
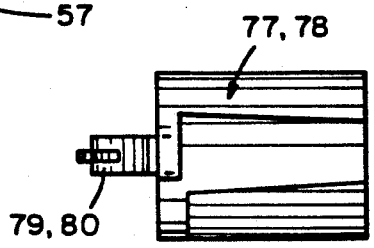
FIG. 14 is a perspective view of the negative sleeve employed in each of the auxiliary receptacles.

A second preferred embodiment of the invention is represented by offset adapter plug 44 shown in FIGS. 8 through 10. This second embodiment incorporates the design and construction of adapter-plug section 3 and elbow section 4 of the first embodiment shown in FIGS. 1 through 7. However, electronics enclosure section 45 includes an electronics circuit board 46, a voltage-selector switch 47, power-indicator LED 48, and a set of sidewall vents 49 formed in enclosure sidewall 50.

Wire conductors 51 and 52 connect conductor plates 9 and 10 to the electrical circuit supported on circuit board 46, and as such, supply operating electrical power to this circuit from receptacle 6 (FIGS. 2 through 4) when offset adapter-plug 44 is inserted into this receptacle. Typically the circuit of circuit board 46 is a voltage-conversion circuit, which through the various selector positions of switch 47 deliver different selectable output voltages to output line cord 53. Circuitry for performing other functions may be incorporated upon circuit board 46 however.

A third preferred embodiment of the invention is represented by offset adapter plug 54 shown in FIGS. 11 through 14. The principal structural difference in offset adapter plug 54 as compared to offset adapter plugs 1 and 44 of the first and second embodiments resides in the substitution of dual-receptacle section 55 for electronic enclosure section 5 of FIGS. 1 through 7 and enclosure section 45 of FIGS. 8 through 10. Specifically, offset adapter plug 54 provides dual power outlets at female receptacles 56 and 57. Adapter plug 58 (FIG. 13 in broken line) inserted into receptacle 56 illustrates the manner in which dual receptacles 56 and 57 are intended to output electrical power through one or two auxiliary adapter plugs, such as adapter plug 58.

Offset adapter plug 54 comprises adapter-plug section 59, elbow section 60 and double-receptacle section 55. These three sections are unified into a single structure by housing 61. Housing 61 is assembled by press fitting and riveting two housing halves **61*a* and 61*b* together. Housing 61** is preferably fabricated from an opaque plastic, such as black polypropylene.

Adapter-plug section 59 is generally constructed in accordance with the same design employed in adapter plug section 3 of the first and second preferred embodiments previously described, except that fuse 13 is eliminated because the power output comprises dual receptacles 56 and 57. Receptacles 56 and 57 are adequately fused by the vehicle fuse system connected to receptacle 6. Accordingly, pleated conductor plate 62 (FIG. 13) extends into firm engagement with positive contact tip 81 to establish an electrical connection.

Elbow section 60 is modified internally compared to elbow section 4 of the prior embodiments to provide guide and support elements 63, 64, 65, 66 and 67 for positive conductor plate 62 and negative conductor plate 68. Conductor plates 62 and 68 extend vertically (FIG. 13) into the interior cavity of dual-receptacle section 55. Conductor plate 62 is formed with two arched contacts **62*a* and 62*b* which serve as positive contacts for receptacles 56 and 57, respectively. Conductor plate 68 has two rivet connectors 68*a* and 68*b* which serve to establish negative connections for receptacles 56 and 57, respectively. Guide and support elements 69 position contact 62*a* and guide and support elements 70 position contact 62*b*. Certain of these guide elements also retain and fix negative contact plate 68**.

Figure 13:
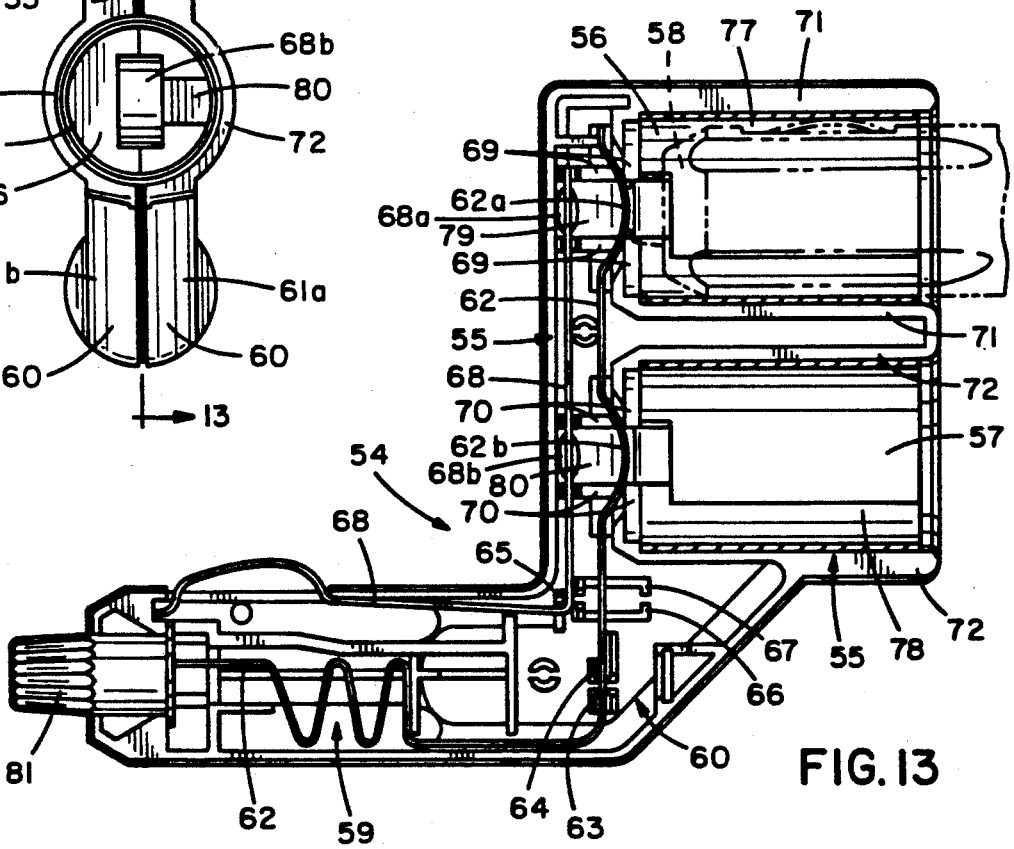
FIG. 13 is an elevation view of FIG. 12 with one-half of the adapter-plug housing removed to show both internal construction details and also the application of a single secondary male adapter plug to one of the female receptacles.

Housing sections **61*a* and 61*b* are formed with interior curved semi-circular walls 71, 72, 73 and 74 (FIGS. 11 through 13) that form circular bores 75 and 76 (FIGS. 12) for receptacles 56 and 57, respectively. A split cylindrical metallic sleeve 77 is lodged within bore 75 and an identical sleeve 78 is lodged within bore 76 (FIG. 4). These sleeves serve as the negative contacts for receptacles 56 and 57, respectively. Sleeves 77 and 78 preferably have the form shown in FIG. 14. Each sleeve is formed with a connector tab 79 or 80 which is fixed to negative conductor plate 68 by rivet connectors 68*a* and 68*b*, respectively (FIG. 13). Accordingly, when adapter plug 58 is inserted into receptacle 56, for example, power is supplied to secondary adapter plug 58 by sleeve 77 and contact 62*a*. Similarly, sleeve 78 and contact 62*b* supply power to receptacle 57**.

It should be understood that the offset adapter plug embodiments disclosed describe preferred embodiments which can be modified without departing from the scope of claimed invention.

What is claimed is:

1. An electrical offset adapter plug for accessing an electrically powered receptacle housed within a compartment having a restricted path by which the adapter plug is inserted into the receptacle, comprising a composite structure including a first adapter-plug section having a generally tubular body which is relatively longer than its tubular diameter and which is adapted for insertion into the receptacle, a second enclosure section defining an internal chamber for housing optional electrical components and serving also as a gripping handle for manual insertion of the offset adapter plug into the receptacle, and a third section defining an offset elbow joining the adapter plug section to the enclosure section with the enclosure section being disposed substantially offset relative to both the length and tubular diameter of the adapter-plug section.

2. The offset adapter plug of claim 1 in which the composite structure includes a housing which defines a continuous internal chamber for all three sections of the offset adapter plug.

3. The offset adapter plug of claim 1 in which a set of auxiliary adapter-plug receptacles are incorporated into the enclosure section and which receptacles are internally connected to the adapter-plug through the internal chamber.

4. The offset adapter plug of claim 3 in which the auxiliary adapter-plug receptacles are disposed in substantially parallel relationship within the enclosure section.

5. The offset adapter plug of claim 4 in which the elongated tubular adapter-plug section and the auxiliary adapter-plug receptacles each have longitudinal axes which are in a parallel relationship.

6. The offset adapter plug of claim 5 in which the longitudinal axis of the adapter-plug section and the auxiliary receptacles are each displaced laterally from one another.

7. The offset adapter plug of claim 6 in which a contact tip of a specific electric polarity projects externally from one end of the offset adapter plug and the auxiliary receptacles are accessed by one or more secondary adapter plugs at an opposite end of the offset adapter plug.

8. The offset adapter plug of claim 7 in which the elbow section has an inclined external wall that joins parallel walls of the enclosure and adapter plug sections at an angle to provide an offset.

9. The offset adapter plug of claim 8 in which the angle is an exterior angle of approximately 135° measured from the inclined elbow wall to the wall of the enclosure section.

10. The offset adapter plug of claim 9 in which the enclosure section is generally rectangular in configuration and in which the enclosure wall joined to the inclined elbow wall is in substantial axial alignment with an adjacent wall of the adapter-plug section.

11. An electrical offset adapter plug for accessing an electrically powered receptacle comprising a first adapter-plug section having a body which is relatively longer than its width and which is adapted for insertion into the receptacle, a second section defining an internal chamber for housing optional electrical circuitry and serving also as a gripping handle for manual insertion of the offset adapter plug into the receptacle, and a third section defining an offset elbow joining the adapter plug section to the enclosure section with the enclosure section being disposed substantially offset relative to both the length and width of the adapter-plug section.

12. The offset adapter plug of claim 11 in which the adapter-plug section and the second section each have a first peripheral wall both of which are in substantial axial alignment but with the walls being displaced along the alignment axis.

13. The offset adapter plug of claim 12 in which the adapter plug section and the second section each have a second peripheral wall both of which are displaced from the alignment axis.

14. The offset adapter plug of claim 13 in which the two second peripheral walls are each disposed on opposite sides of the alignment axis.

15. The offset adapter plug of claim 14 in which a pair of auxiliary electrical receptacles are housed in the second section.

16. The offset electrical adapter plug of claim 15 in which the auxiliary electrical adapter plugs are accessed from an end of the offset electrical plug opposite the adapter plug section.

* * * * *